United States Patent [19]

Zedler

[11] 4,247,846

[45] Jan. 27, 1981

[54] ALARM NOTIFICATION APPARATUS

[75] Inventor: Martin R. Zedler, Lake Charles, La.

[73] Assignee: Conoco, Inc., Ponca City, Okla.

[21] Appl. No.: 29,224

[22] Filed: Apr. 11, 1979

[51] Int. Cl.[3] ..... G08B 3/00

[52] U.S. Cl. ..... 340/523; 340/147 LP; 340/539

[58] Field of Search ..... 340/523, 539, 147 LP; 455/58

[56] References Cited

U.S. PATENT DOCUMENTS

| | | | |
|---|---|---|---|
| 3,568,161 | 3/1971 | Knickel | 340/29 |
| 3,750,110 | 7/1973 | Martin | 340/146.1 C X |
| 3,914,692 | 10/1975 | Seaborn | 325/53 |
| 3,925,763 | 12/1975 | Wadhwani | 340/164 R |
| 3,939,460 | 2/1976 | Horn | 340/408 |
| 3,978,475 | 8/1976 | Schmitz | 340/420 |
| 3,978,477 | 8/1976 | Schmitz | 340/420 |
| 3,978,478 | 8/1976 | Schmitz | 340/420 |
| 3,978,479 | 8/1976 | Schmitz | 340/420 |
| 4,006,460 | 2/1977 | Hewitt | 340/149 R |

*Primary Examiner*—Harold I. Pitts
*Attorney, Agent, or Firm*—A. Joe Reinert

[57] ABSTRACT

An alarm system for notifying personnel in an adjustably set priority sequence of an alarm condition includes one or more alarm sensors, a central alarm station, a plurality of primary remote stations, and one or more secondary remote stations. The alarm sensors are connected to the central alarm station to communicate the occurrence of alarm conditions thereto. The central alarm station includes a priority selector device, a device for establishing a primary notification signal based upon the signals received from the alarm sensors and upon the setting of the priority selector device. The central alarm station also includes a transmitter for transmitting the notification signal to the primary remote stations and a receiver for receiving an acknowledgement signal from the primary remote stations. The primary remote stations each include a receiver for receiving the notification signal, an address detector device, a display device, a response encoder device, and a transmitter for transmitting the acknowledgement signal from the response device. The primary remote stations include another transmitter for transmitting a secondary notification signal to the secondary remote stations. The secondary remote stations include a receiver for receiving this secondary notification signal and also an indicator device and reset device for indicating the reception of the signal from the primary remote station.

21 Claims, 6 Drawing Figures

ALARM NOTIFICATION APPARATUS

BACKGROUND OF THE INVENTION

1. Field of the Invention

This invention relates generally to apparatus for monitoring alarms and providing notification signals when an alarm condition occurs and more particularly, but not by way of limitation, to apparatus for detecting when an alarm condition occurs and generating notification signals in a variable sequence of priorities.

2. Description of the Prior Art (Prior Art Statement)

U.S. Pat. No. 3,914,692 issued to Seaborn, Jr. discloses an emergency communication system which is proposed to include a portable unit communicating with a console which in turn communicates with a central station via leased telephone lines. In operation the portable unit detects emergency conditions and sends signals via the telephone lines to the central station for acknowledgement thereby. Once the central station has received an alarm signal, it is capable of generating a call for assistance and a signal to notify the portable unit that assistance is on the way.

U.S. Pat. No. 3,925,763 issued to Wadhwani et al. discloses a security system which includes various sensors, line converters, remote input and output devices, a master controller, and a remote central station. These elements are proposed to be combined so that they may detect alarm conditions and report the occurrence thereof to the central station.

In addition to the above two patents, Applicant knows of the following references which also deal with alarm and security systems

| U.S. Pat. No. | Patentee |
|---|---|
| 4,006,460 | Hewitt et al. |
| 3,939,460 | Horn et al. |
| 3,750,110 | Martin et al. |
| 3,568,161 | Knickel |
| 3,978,479 | Schmitz |
| 3,978,478 | Schmitz |
| 3,978,477 | Schmitz |
| 3,978,475 | Schmitz |

Upon examination of these references, it will be noted that the disclosures generally propose apparatus for detecting alarm conditions and relaying such detection information to a central information gathering device. Also generally disclosed are proposals for using various types of computers and interconnecting these computers to the alarm sensors.

In light of such disclosures, Applicant believes that none of these references, either individually or collectively, discloses the invention hereinafter disclosed. In particular, these references fail to teach an apparatus which, after having received alarm condition information from the sensors, automatically establishes a notification signal having a format designed to notify one of a plurality of primary remote units in a variable sequence of priorities. The above references also fail to disclose priority notification apparatus in which the priority sequence can be modified. Still another shortcoming of these references is the lack of a disclosure of an alarm system having a plurality of secondary remote units which are activated by signals generated by the respectively associated primary remote units.

SUMMARY OF THE INVENTION

The present invention overcomes the above-noted and other shortcomings of the prior art by providing a novel and improved alarm notification apparatus. This invention provides a means for communicating a signal to one of a plurality of primary remote units to notify the unit of an alarm condition. Additionally, this invention includes a means for adjustably setting a sequence of priorities among the remote units according to which the notification signal is to be sent. Furthermore, the present invention includes a means for sending a secondary notification signal to a respective one of a plurality of secondary remote units associated with the primary remote units. One further advantage of the present invention is that it operates automatically to generate, send, receive and alert personnel to the priority-defined notification signals.

These features make the present invention useful in a variety of environments. For example, one of these environments is, in general, the oil industry, and in particular, the field production of oil where a plurality of critical functions must be constantly monitored for abnormal conditions and where geographically dispersed personnel must be quickly summoned to correct such abnormal conditions whenever they occur. When used in this setting, the present invention monitors these critical functions throughout the field. For example, flowmeters, high-level floats on tanks, well status alarms, and security systems can be monitored for the occurrence of abnormal conditions. When an abnormal condition occurs, the monitoring sensor placed at the critical location provides an alarm indication signal to a central alarm station which in turn establishes a notification signal upon receipt of the alarm signal. This notification signal is then transmitted to a plurality of primary remote units for the purpose of notifying the personnel at the priority-selected one of these units of the alarm condition. In this way critical conditions are monitored and assistance summoned automatically when these conditions reach alarm states. Thus this alarm notification system can automatically obtain emergency assistance from personnel scattered over a wide geographical area. Furthermore, according to the present invention this notification process can occur in a variety of sequences as determined by the adjustable setting of a priority sequence setting means. This automatic priority calling system therefore obviates the necessity of going through an answering service which requires a person stationed thereat to manually call the people to be notified of the emergency situation.

Structurally, this alarm system for notifying personnel in an adjustably set priority sequence of an alarm condition includes an alarm means, a central alarm station, and a plurality of primary remote stations each having its own predetermined address. This system may also include one or more secondary remote stations associated with the primary remote stations.

The alarm means includes one or more sensors for placement at the critical locations to be monitored. These sensors communicate with the central alarm station for providing alarm condition signals thereto.

The central alarm station generally includes a means for adjustably setting the priority sequence of the primary remote station addresses. The central alarm station further includes a means connected to both the alarm means and the priority setting means for establishing a primary notification signal when the alarm means indicates an alarm condition has occurred. The central alarm station further includes a transmitter means for transmitting the notification signal to the primary remote stations. There is also a receiver means within the central alarm station for receiving acknowledgement signals from the primary remote stations.

Each of the primary remote stations includes a receiver means for receiving the notification signal from the central alarm station. Each remote station also includes a means for detecting when the notification signal has a format which includes the address of that particular remote station. Also included in the primary remote station are an indicating means for providing a signal notifying the personnel at the remote station of the alarm condition and a means associated with the indicating means for acknowledging the receipt of the notification signal. Each primary remote station also has a transmitter means for transmitting the acknowledgement to the central alarm station and another transmitter means for sending a secondary notification signal to a secondary remote station associated therewith.

The secondary remote station includes a receiver means for receiving the secondary notification signal from the primary remote station associated with the secondary remote station. The secondary remote station further includes a display means by which personnel associated therewith can be notified of the reception of the secondary notification signal.

Operationally, when one or more of the sensors of the alarm means detects an alarm condition, it sends an alarm signal to the central alarm station. Upon receipt of an alarm condition signal, the central alarm station creates a primary notification signal which includes in its format the address of the primary remote unit which has the highest priority as established by the adjustable priority setting means. Once the notification signal has been created, it is transmitted to and received by each of the primary remote stations.

Upon receipt of a notification signal, each primary remote station automatically checks the address format of the primary notification signal to determine if it is the primary remote station which has been called. The primary remote station which has been addressed then further processes the notification signal to determine which alarm sensor has indicated that an alarm condition exists. A visual, or other type of indication, is provided at the primary remote station to notify personnel located thereat which such sensor it is.

The personnel at the primary remote station, upon seeing the visual or other display, activates an acknowledgement signal. This signal is transmitted by the primary remote station to the central alarm station to prevent the central alarm station from creating subsequent notification signals addressing those primary remote stations having priorities lower than the priority of the acknowledging primary remote station. However, if such acknowledgement signal is not received by the central alarm station within a predetermined time period, the central alarm station then does create subsequent notification signals which are addressed to lower priority primary remote stations. This repetitive process of addressing lower priority remote stations continues until an acknowledgement signal is received from one of them within the predetermined time period.

Additionally, when a primary remote station receives a notification signal addressed to it, a secondary notification signal is automatically generated by the primary remote station for transmission to the secondary remote station associated therewith. When this secondary notification signal is received by the secondary remote station, an indicator means is activated to notify personnel thereat of the receipt of the secondary notification signal. A reset signal can be activated by the personnel at the secondary remote station to reset the indicator means.

From the foregoing it is a general object of the present invention to provide a novel, improved and useful alarm notification apparatus. Other and further objects, features and advantages of the present invention will be readily apparent to those skilled in the art upon a reading of the description of the preferred embodiment which follows, when taken in conjunction with the accompanying drawings.

DETAILED DESCRIPTION OF PREFERRED EMBODIMENT OF THE INVENTION

Figure 1:
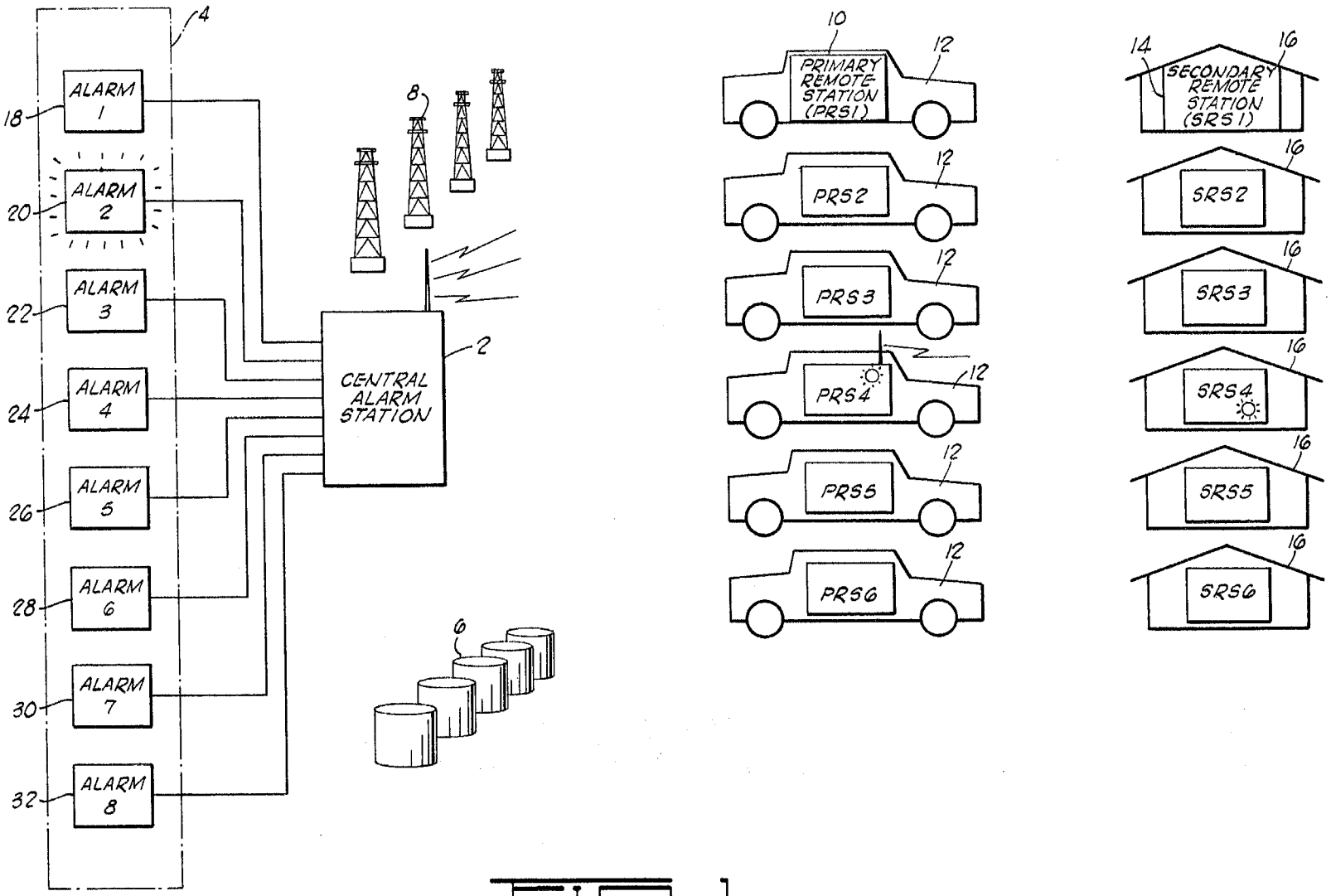
FIG. 1 is a pictorial illustration of the present invention in one environment of use.

Referring now to the drawings, and in particular to FIG. 1, an alarm notification system according to the present invention is seen figuratively placed in a preferred use environment of a petroleum production field. The alarm system includes a central alarm station 2 to which an alarm means 4 is connected. The central alarm station 2 and the alarm means 4 are disposed within the field depicted by storage tanks 6 and drilling rigs 8. The alarm system further comprises a plurality of primary remote stations 10 which may be remotely located from the central alarm station 2 as depicted by their placement in their respective vehicles 12. Each primary remote station has its own predetermined address. Still further included in the alarm system is one or more secondary remote stations 14 shown located in respective houses 16. A shown in FIGURE 1, each secondary remote station 14 is associated with a respective primary remote station 10.

The alarm means 4 includes one or more alarm condition detection devices such as those indicated in FIG. 1 by the reference numerals 18, 20, 22, 24, 26, 28, 30 and 32. These detection devices 18–32 may be ordinary sensors which are selected according to, and placed at, the critical locations to be monitored. Upon placement and activation of these devices 18–32, these devices detect when their respective ambient conditions reach the alarm conditions for which they are set to detect. When a device detects the occurrence of such an alarm condition, it generates an electrical alarm condition signal and communicates this signal to the central alarm station 2.

Figure 2A:
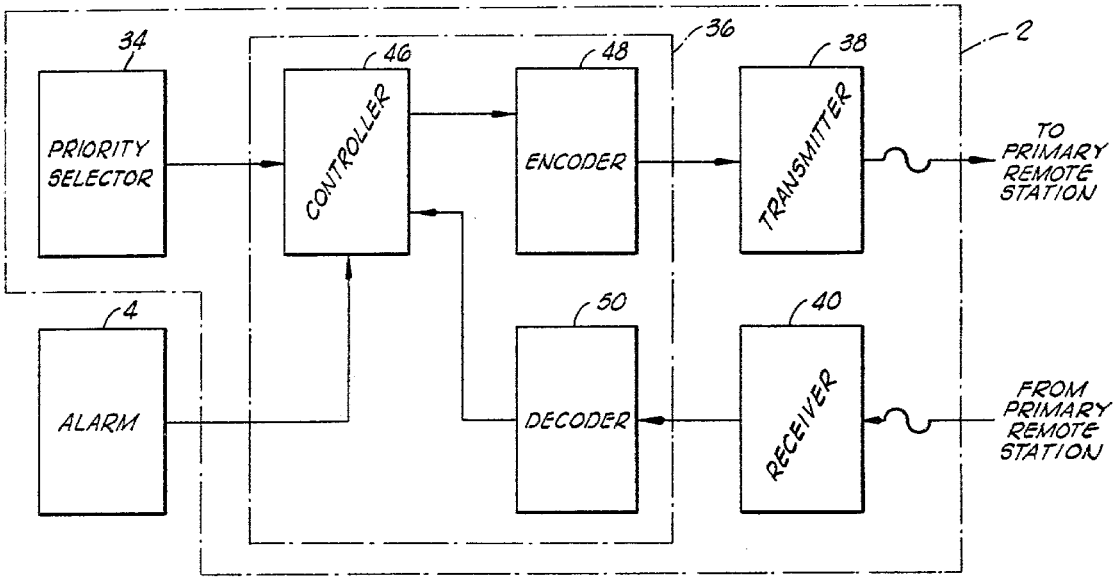
FIG. 2A is a block diagram of the alarm means and the central alarm station of the present invention.

The central alarm station 2 receives each such alarm condition signal from the alarm means 4 and processes it through the means schematically represented in the block diagram of FIG. 2A. This central alarm station 2 includes a priority selector means 34 which is a means for adjustably setting a priority sequence of numbers. The priority selector means 34 connects to a means 36 for establishing a primary notification signal having a format defined by information received from the priority selector means 34 and from the alarm means 4 which is also connected to the establishing means 36. Further connected to the establishing means 36 within the central alarm station 2 is a transmitter means 38 which is used to transmit the primary notification signal to the primary remote stations 10. Still further connected to the establishing means 36 within the central alarm station 2 is a receiver means 40 which receives signals from the primary remote stations 10 for acknowledging receipt of the primary notification signal transmitted thereto. After receiving these acknowlegement signals, the receiver means 40 communicates them to the establishing means 36 to control the establishing of subsequent primary notification signals.

Figure 3:
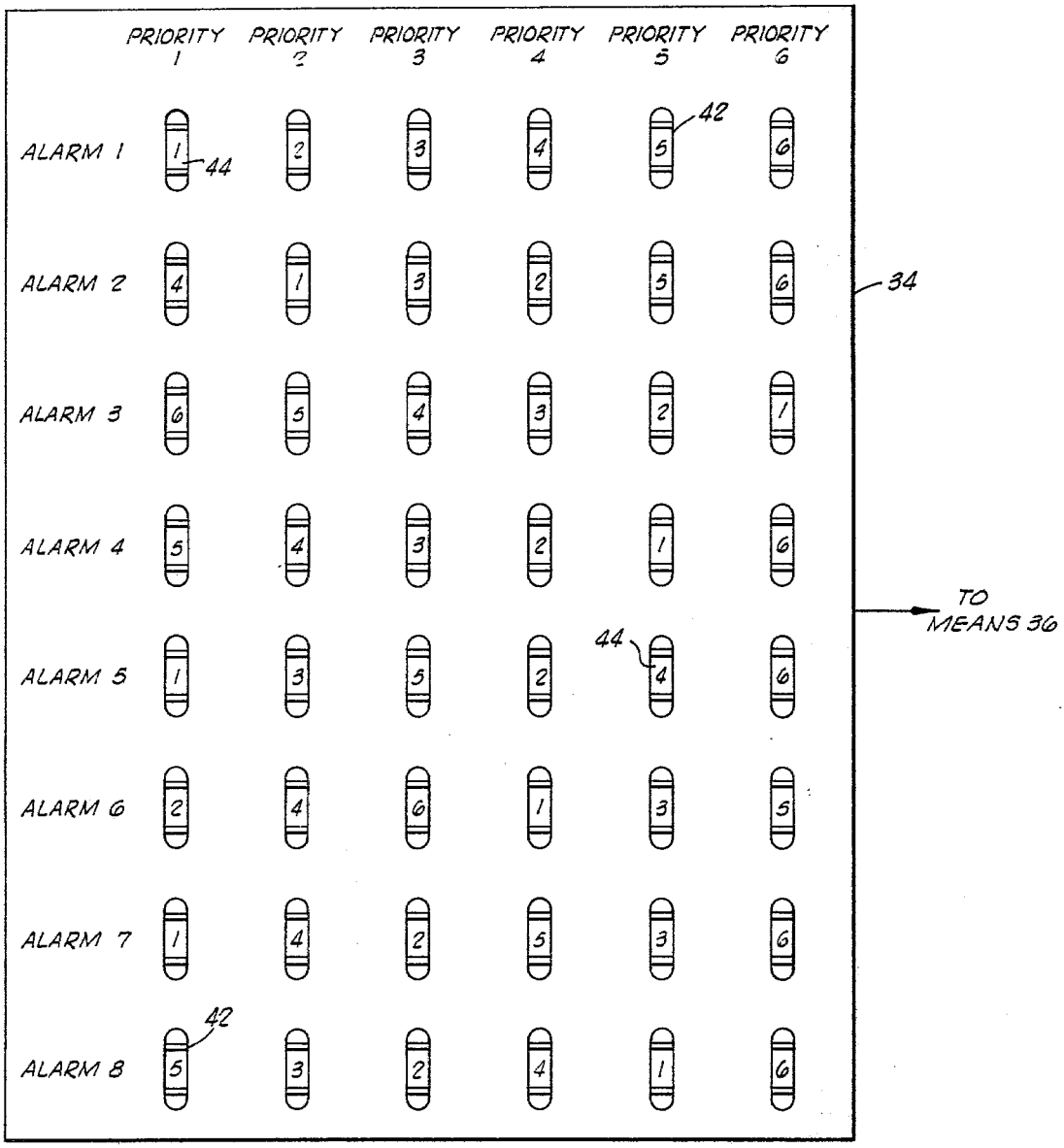
FIG. 3 is an illustration of a preferred embodiment of the priority selector means of the present invention.

With more particular reference to the elements of the central alarm station 2, one embodiment of the priority selector means 34 which may be used with the number of alarm detection devices and primary remote stations shown in FIG. 1 is shown in FIG. 3. The priority selector means 34 includes a plurality of switch means 42, each having a plurality of selectable switch settings 44. In a preferred embodiment these switch means 42 are thumbwheel switches. Also these switch means 42 are disposed in an array or matrix, whereby a plurality of rows and columns of the switch means 42 are defined. Each row is shown in FIG. 3 to correspond to a respective one of the alarm condition detection devices 18–32 ("ALARM 1", "ALARM 2", etc.). Each column of switch means 42 corresponds to a respective priority level ("PRIORITY 1", "PRIORITY 2", etc.). Each setting of each switch means 42 corresponds to a respective one of the predetermined primary remote station addresses. In this way the priority selector means 34 provides a means for independently adjustably setting a variety of possible priority sequences for each alarm device. For example, FIG. 3 shows that for ALARM 1, the primary remote station having an address corresponding to the first position of the switch means 42 has PRIORITY 1; similarly, for ALARM 1, PRIORITY 2 is assigned to the primary remote station having an address corresponding to the second position of the switch means 42. On the other hand, for ALARM 2, the highest priority (PRIORITY 1) is assigned to the primary remote station having an address corresponding to the fourth position of the switch means 42, whereas PRIORITY 2 is assigned to the primary remote station which has the highest priority for ALARM 1 (i.e., primary remote station 1).

The establishing means 36 is shown in FIG. 2A to include a control means 46, an encoding means 48 and a decoding means 50. The encoding means 48 is connected to the output of the control means 46 and to the input of the transmitter means 38. The decoding means 50 is connected to an input of the control means 46 and to the output of the receiver means 40.

The control means 46, in a preferred embodiment, is a microprocessor. This microprocessor performs the several functions otherwise performed by the various elements in other embodiments of the control means 46. In particular these various elements include a means for monitoring the alarm means 4 and also a means for monitoring the priority selector means 34. These other elements also include a means which is associated with both of the monitoring means for selecting the primary remote station address as specified by the appropriate priority level. Further there is a means associated with the selecting means for generating the primary notification signal having the selected address. There is also a means for determining if an acknowledgement signal has been received within a predetermined time period to thereby prevent the selecting means and generating means from providing subsequent primary notification signals addressed to lower priority remote stations. These elements also include a means for arranging a hierarchy among the alarm condition signals which are simultaneously received from the alarm means 4 so that the control means 46 may provide an orderly series of primary notification signals respectively identifying the various alarm conditions.

The encoding means 48, in a preferred embodiment, is a 16-bit encoder programmed by the microprocessor to translate parallel information from the microprocessor output to which the encoding means 48 is connected into serial information for transmission to the primary remote stations 10. The first eight bits of the 16-bit series represents the priority-selected predetermined address of a respective one of the primary remote stations 10. The second eight bits of information identify the alarm condition detection device which is signalling the occurrence of an alarm condition.

The decoding means 50 decodes, or converts, the serially-formatted acknowledgement signal received by the receiver means 40 into a parallel format for input into the control means 46. The microprocessor in the preferred embodiment control means 46 analyzes this parallel information to determine if the received information is a response to the primary notification signal. If it is a response and it has been received within the time period predetermined by the control means 46, the microprocessor may halt the generation of further primary notification calls until the next alarm condition is received from the alarm means 4.

The transmitter means 38 is connected to the establishing means 36 for transmitting the primary notification signal established thereby to the primary remote stations 10. The transmitter means 38 may be of an ordinary type known in the art such as a 40-watt, 452 MHz transmitter.

The receiver means 40 is connected to the establishing means 36 for communicating signals received from the primary remote stations 10 thereto. It may also be of an ordinary type known in the art such as a 49.2 MHz receiver.

Figure 2B:
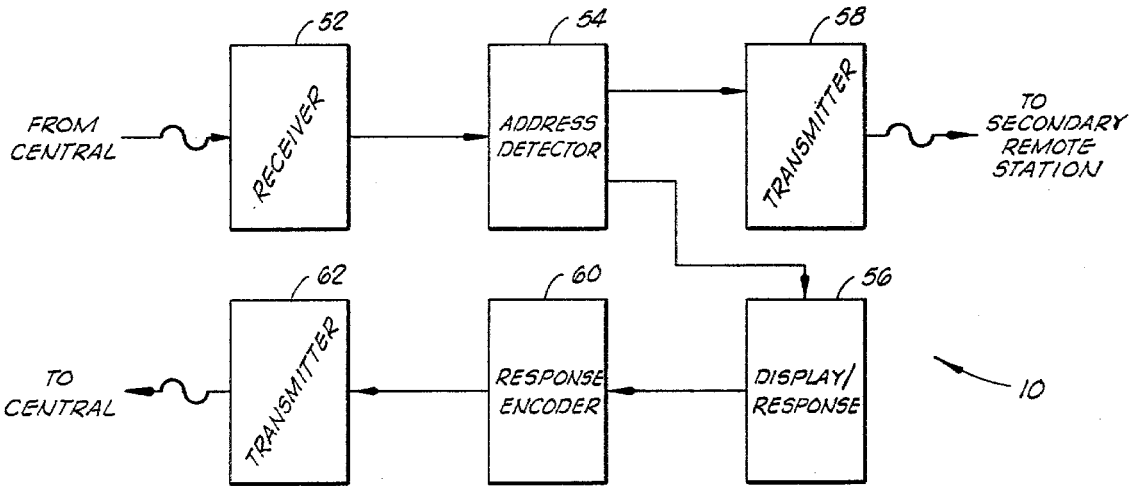
FIG. 2B is a block diagram of a primary remote station of the present invention.

With reference now to FIG. 2B, one will see that each of the primary remote stations 10 contains a receiver means 52 for receiving the primary notification signal transmitted by the central alarm station 2, an address detector means 54 connected to the receiver means 52 for detecting if the received primary notification signal contains the predetermined address of the respective primary remote station 10, and a display means 56 for indicating to personnel located at the primary remote station that the respective station has been called by the primary notification signal. This display means 56 is connected to the address detecting means 54. Also connected to the address detecting means 54 is a transmitter means 58 which transmits a secondary notification signal to the secondary remote station associated with the respective primary remote station. Each primary remote station 10 further includes a means for acknowledging the receipt of a primary notification signal which has addressed the respective primary remote station. In the FIG. 2B block diagram this means includes response activation buttons associated with the display means 56 and a response encoding means 60 connected thereto. Connected to the response encoding means 60 is a transmitter means 62 for transmitting the acknowledgment signal to the central alarm station 2.

The receiver means 52 may be of an ordinary type known in the art such as a 452 MHz receiver to receive the 452 MHz primary notification signal transmitted by the exemplary 452 MHz transmitter means 38.

The address detecting means 54 processes the received primary notification signal to determine if the first eight bits thereof match the address of the respective primary remote station 10. If the address matches, then the address detecting means 54 activates the transmitter means 58 to send a secondary notification signal to the secondary remote station associated therewith. It also activates the display means 56 to light lights or sound horns or buzzers, for example. This activation of the display means 56 is done in accordance with the analysis by the detector means 54 of the second eight bits of the received primary notification signal which indicate the appropriate light to be lit to correspond to the appropriate alarm number.

Figure 4:
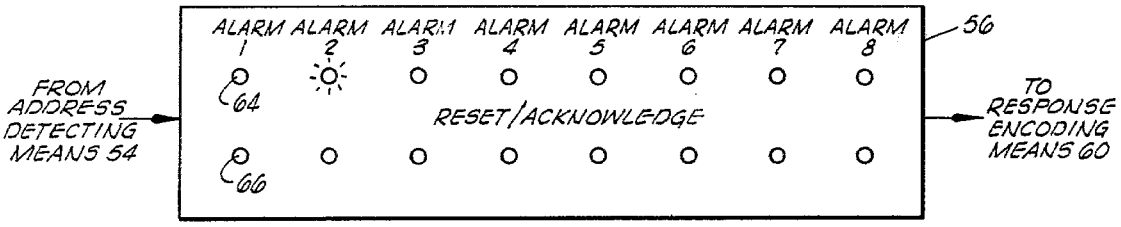
FIG. 4 is an illustration of a preferred embodiment of the display means of a primary remote station of the present invention.

The display means 56 includes an appropriate number of indicators, such as lights 64 as shown in FIG. 4, which correspond to the number of alarm condition detection devices 18–32 contained in the alarm system. Furthermore, there is a corresponding number of reset-acknowledge switch means 66 which are activated by personnel located at the primary remote station 10 to notify the central alarm station 2 of the receipt of the primary notification signal. In a preferred embodiment the display means 56 displays the detection of an alarm condition by having the appropriate light 64 flash when the primary notification signal has been received. Upon activation of the reset/acknowledge switch means 66, the flashing light will go to a continuous "on" state if the alarm condition still exists or the light will be extinguished if the alarm has cleared.

When one of the acknowledge switches 66 has been activated, as acknowledgement signal is generated and sent to the response encoding means 60 for processing into a serial format for transmission by the transmitter means 62 to the central alarm station 2. The transmitter means 62 is of an ordinary type known in the art such as a 49.2 MHz transmitter to complement the exemplary 49.2 MHz receiver located at the central alarm station 2.

The transmitter means 58 is also of an ordinary type known in the art, except that in the preferred embodiment of the present invention it is a short range, frequency shift keying (FSK) transmitter. This short range is desirable because it is used primarily only for night communications when the personnel who would normally be at the primary remote station 10 located in vehicle 12 is in his house 14 as shown in FIG. 1. However, it is to be noted that this transmitter means in addition to the other transmitter means and receiver means mentioned herein, may be of any type which is known by those having ordinary skill in the art to be appropriate. It is to be further noted that the transmitter means and the receiver means are radio transmitters and receivers in their preferred embodiments for electromagnetically associating the central alarm station with the primary remote stations and for electromagnetically associating the primary remote stations with the secondary remote stations. However, these means may, in general, be any appropriate devices for communicating information therebetween.

Figure 2C:
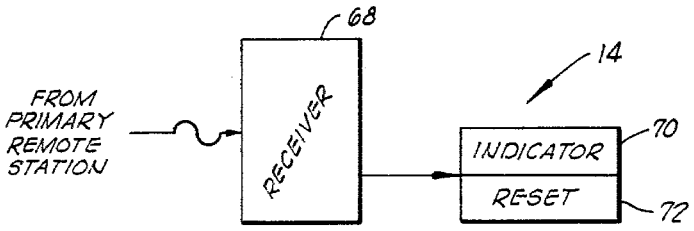
FIG. 2C is a block diagram of a secondary remote station of the present invention.

With reference now to FIG. 2C it will be seen that the secondary remote stations 14 each include a receiver means 68 for receiving the secondary notification signal transmitted by the primary remote station 10 associated therewith. The secondary remote station also includes a means 70 for indicating the reception of the secondary notification signal and a means 72 for resetting the indicating means. For example, the indicating means may be a buzzer which is activated when the receiver means 68 receives the secondary notification signal. Upon activation of the reset means, the buzzer is reset.

Referring again to FIGS. 1 and 3 primarily, the operation of the preferred embodiment of the present invention will be described. Initially, each of the primary remote stations 10 is assigned its own predetermined address by setting different addresses in each of the address detecting means 54. Each of these addresses corresponds to a respective selectable switch setting 44 of the switch means 42. Through this correspondence it is apparent that the priority selector means 34 can be adjustably set to select a variety of priority sequences. It is in these sequences that the central alarm station 2 will place the primary notification signal calls to the primary remote stations. For example, in FIG. 3 it is seen that the priority sequence for ALARM 1 is set to address the first primary remote station (PRS 1) first because that is the address represented by the switch means 42 setting under PRIORITY 1. Similarly, it is seen that for ALARM 2 the highest priority address is that of the fourth primary remote station PRS 4). This latter priority setting is illustrated in FIG. 1.

In the FIG. 1 illustration, ALARM 2 detects an alarm condition and sends an alarm condition signal to the central alarm station 2. The central alarm station 2 checks the priority setting of the priority selector means 34 and determines that for ALARM 2 the highest priority address is that of PRS4. Therefore, the central alarm station 2 transmits a primary notification signal containing the address of PRS4.

Upon reception and decoding of the primary notification signal, PRS4 lights the light 64 located at the ALARM 2 position as shown in FIG. 4. The person located at PRS4 activates the switch 66 below the ALARM 2 light 64 to acknowledge receipt of the alarm signal. When this acknowledgement switch is activated, it generates an acknowledgement signal which is transmitted by the primary remote station and received by the central alarm station 2. The reception of the acknowledgement signal prevents the central alarm station 2 from generating subsequent primary notification signals calling primary remote stations having lower priorities than PRS4. However, it is to be noted that this acknowledgement procedure must be accomplished within a predetermined time period as established by the control means 46 of the central alarm station 2. If the acknowledgement signal is not received within this predetermined time period, then the central alarm station 2 checks the priority selector means 34 to determine the address of the primary remote station under the PRIORITY 2 column associated with the ALARM 2 row. When this new address is determined, a subsequent primary notification signal is generated and transmitted for reception by all of the primary remote stations 10, but for identification only by that primary remote station having the respective address contained in the primary notification signal.

Additionally, when PRS4 receives its primary notification signal, the transmitter means 58 located thereat propagates a secondary notification signal to its respectively associated secondary remote station (SRS4). If PRS4 and SRS4 are within operating range, SRS4 receives the secondary notification signal and activates the indicating means located thereat. This secondary indication is reset by activating the reset means of SRS4.

From this description of the operation it is apparent that this system allows complete versatility as to which remote station is to be called when an alarm condition is detected, in what order the primary remote stations are to be called, and how many of the primary remote stations are to try for each alarm. Thus, the present invention for notifying remote stations in an adjustably set priority sequence of an alarm condition is well adapted to carry out the objects and attain the ends and advantages mentioned above as well as those inherent therein. While preferred embodiments of the invention have been described for the purpose of the disclosure, numerous changes in the construction and arrangement of parts can be made by those skilled in the art, which changes are encompassed within the spirit of this invention as defined by the appended claims.

The embodiments of the invention in which an exclusive property or privilege is claimed are defined as follows:

1. An alarm system for notifying personnel in an adjustably set priority sequence of an alarm condition, comprising:

an alarm means;

a plurality of primary remote stations, each having a different predetermined address and each including:

first receiver means for receiving a primary notification signal;

first transmitter means for transmitting an acknowledgement signal when said received primary notification signal has a format including the predetermined address of a respective one of said primary remote stations; and a central alarm station associated with said alarm means and said primary remote stations, including:

means for adjustably setting a priority sequence of said remote station addresses;

means connected to said alarm means and to said setting means for establishing said primary notification signal when said alarm means indicates an alarm condition has occurred, said establishing means providing said primary notification signal with a format having the address of that respective one of said plurality of primary remote stations having the highest priority as set by said setting means and establishing subsequent primary notification signals addressing others of said primary remote stations having successive lower priorities when said establishing means does not receive said acknowledgement signal from the last addressed primary remote station within a predetermined amount of time;

second transmitter means for transmitting said primary notification signal to said primary remote stations; and second receiver means for receiving said acknowledgement signal from the primary remote station detecting the primary notification signal having its predetermined address, and for communicating said acknowledgement signal to said establishing means to prevent said establishing means from establishing said subsequent primary notification signals having formats with addresses of remote stations having successively lower priorities.

2. An alarm system as recited in claim 1, wherein said setting means includes a plurality of switch means, each having a plurality of selectable switch settings.

3. An alarm system as recited in claim 2, wherein:

said alarm means includes a plurality of alarm condition detection devices; and said plurality of switch means are positioned in a matrix thereby providing rows and columns of said switch means, each row representing a respective one of said plurality of alarm condition detection devices, each column representing a respective one of said priorities, and each selectable switch setting of each of said switch means representing a predetermined address of a respective one of said primary remote stations.

4. An alarm system as recited in claim 3, wherein said switch means are thumbwheel switches.

5. An alarm system as recited in claim 1, wherein said establishing means includes a control means comprising:

means for monitoring said alarm means;

means for monitoring said setting means;

means associated with both of said monitoring means for selecting the predetermined primary remote station address at the appropriate priority level when an alarm condition is detected;

means associated with said selecting means for generating said primary notification signal having said selected predetermined address;

means for determining if said acknowledgement signal is received within a predetermined time period thereby to prevent said selecting means and said generating means from providing a subsequent primary notification signal addressing a primary remote station having a lesser priority.

6. An alarm system as recited in claim 5 wherein:

said alarm means includes a plurality of alarm condition detection devices for providing alarm condition signals to said alarm monitoring means; and said generating means includes means for arranging a hierarchy among the alarm condition signals which are simultaneously detected by said alarm monitoring means so that an orderly series of primary notification signals can be generated and transmitted to said primary remote stations.

7. An alarm system as recited in claim 6 wherein said control means is a microprocessor.

8. An alarm system as recited in claim 1 wherein each of said primary remote stations includes:

means connected to said first receiver means for detecting when a primary notification signal having a format containing a respective predetermined address has been received;

means connected to said detecting means for displaying to personnel at said primary remote station when said primary notification signal having a predetermined address has been received; and means associated with said displaying means for generating said acknowledgement signal.

9. An alarm system as recited in claim 8 wherein said displaying means includes visual and audible indicators.

10. An alarm system as recited in claim 8 wherein:
said alarm means includes a plurality of alarm condition detection devices; and
said displaying means includes a plurality of visual indicators, each indicator corresponding to a respective one of said plurality of alarm condition detection devices and being activated when said received primary notification signal includes information within its format indicating that said respective detection device indicates an alarm condition.

11. An alarm system as recited in claim 1 wherein each of said primary remote stations further includes a third transmitter means associated with said first receiver means for transmitting a secondary notification signal when said received primary notification signal contains the predetermined address of the respective primary remote station.

12. An alarm system as recited in claim 11 further comprising a secondary remote station associated with one of said primary remote stations, said secondary remote station including:
a third receiver means for receiving said secondary notification signal from said third transmitter means of said associated primary remote station; and
means for indicating to personnel at said secondary remote station when said third receiver means has received said secondary notification signal.

13. An alarm system as recited in claim 12 wherein said secondary remote station further includes means for resetting said indicating means.

14. An alarm system for providing notification signals in an adjustably set priority, comprising:
a plurality of detection devices for monitoring ambient conditions for alarm states and for providing alarm signals when said alarm states occur;
a central alarm station to which said detection devices are connected, said central station including:
an array of switch means, each switch means having a plurality of selectable switch settings for adjustably setting a plurality of priority sequences among a plurality of predetermined addresses, each of said addresses corresponding to a respective one of said selectable switch settings;
means for providing, when an alarm signal occurs, a primary notification signal having a format including one of said plurality of predetermined addresses in accordance with said set priority sequences and including the identification of the detection devices from which the alarm signal came;
a plurality of primary remote stations associated with said central station, each primary remote station having assigned thereto a different one of said plurality of predetermined addresses and including:
means for detecting when said primary notification signal provided by said central alarm station contains the respective predetermined address of the respective primary remote station;
means for displaying, when said address has been detected, which of said detection devices provided said alarm signal to said central alarm station;
means for propagating a secondary notification signal when said address has been detected; and
a plurality of secondary remote stations, each associated with a respective one of said primary remote stations and each including: means for receiving said secondary notification signal; and
means for indicating the reception of said secondary notification signal.

15. An alarm system as recited in claim 14 wherein said primary remote stations are electromagnetically associated with said central alarm station and said secondary remote stations are electromagnetically associated with said primary remote stations.

16. A method of notifying personnel in an adjustably set priority sequence of an alarm condition, comprising the steps of:
disposing an alarm means at a location which is to be monitored for an alarm condition;
communicating an alarm condition signal from said alarm means to a central alarm station when said alarm means detects the occurrence of an alarm condition;
adjustably setting a priority sequence of addresses of a plurality of primary remote stations;
establishing a primary notification signal having the highest priority address contained therein;
transmitting said primary notification signal to said primary remote stations;
receiving said primary notification signal at each of said primary remote stations;
analyzing said received primary notification signal for determining the address contained therein;
indicating the reception of said primary notification signal to personnel located at the primary remote station having the address contained within said primary notification signal;
transmitting an acknowledgement signal to said central alarm station;
receiving said acknowledgement signal at said central alarm station and determining if said acknowledgement signal has been received within a predetermined time period;
establishing and transmitting subsequent primary notification signals containing addresses having lower priorities than the last transmitted primary notification signal when said acknowledgement signal has not been received within said predetermined time period; and
terminating said establishment of subsequent primary notification signals when said acknowledgement signal is received within said predetermined time period.

17. A method as recited in claim 16 further including, after the step of analyzing said received primary notification signal for determining the address contained therein, the steps of:
generating a secondary notification signal at the primary remote station addressed by the primary notification signal;
receiving said secondary notification signal at a secondary remote station; and
indicating the reception of said secondary notification signal at said secondary remote station.

18. An alarm system for providing notification signals in an adjustably set priority, comprising:
a plurality of individually identifiable detection devices for monitoring ambient conditions for alarm states and for providing electrical alarm signals when said alarm states occur;
a central alarm station to which said detection devices are connected, said central alarm station including:

an array of switch means, each switch means having a plurality of selectable switch settings for adjustably setting a plurality of priority sequences among a plurality of predetermined addresses, each of said addresses corresponding to a respective one of said selectable switch settings;

electronic control circuit means for providing, when an electrical alarm signal is provided by one of said detection devices and is communicated to said electronic circuit means, a primary notification signal having a format including one of said plurality of predetermined addresses in accordance with said set priority sequences and including the identification of the detection devices from which the alarm signal is provided; and a plurality of primary remote stations associated with said central alarm station, each primary remote station having assigned thereto a different one of said plurality of predetermined addresses and including:

electronic address detector circuit means for detecting when said primary notification signal provided by said central alarm station contains the respective predetermined address of the respective primary remote station;

means for displaying, when said respective predetermined address has been detected, which of said detection devices provided said alarm signal to said central alarm station; and electronic notification circuit means for propagating a secondary notification signal when said address has been detected.

19. An alarm system as recited in claim 18, further comprising:

a plurality of secondary remote stations, each associated with a respective one of said primary remote stations and each including:

receiver means for receiving said secondary notification signal; and indicator means for indicating the reception of said secondary notification signal.

20. An alarm system as recited in claim 19, wherein said primary remote stations are electromagnetically associated with said central alarm station and said secondary remote stations are electromagnetically associated with said primary remote stations.

21. An apparatus as recited in claim 20, wherein said electronic control circuit means includes a microprocessor.

* * * * *